US005884467A

United States Patent [19]

Glesser

[11] Patent Number: 5,884,467

[45] Date of Patent: Mar. 23, 1999

[54] SELF-ATTACHING ROPE

[75] Inventor: Louis S. Glesser, Golden, Colo.

[73] Assignee: Spyderco, Inc., Golden, Colo.

[21] Appl. No.: 927,702

[22] Filed: Sep. 11, 1997

Related U.S. Application Data

[60] Provisional application No. 60/025,948 Sep. 11, 1996.

[51] Int. Cl.[6] ..... D02G 3/02

[52] U.S. Cl. ..... 57/210; 57/200; 57/231

[58] Field of Search ..... 24/115 A, 115 R, 24/128; 57/210, 211, 231, 232, 235, 200

[56] References Cited

U.S. PATENT DOCUMENTS

| | | | |
|---|---|---|---|
| 993,031 | 5/1911 | Coleman | 57/211 |
| 3,043,086 | 7/1962 | Hood | 57/210 |
| 4,563,869 | 1/1986 | Stanton | 57/211 |
| 5,131,218 | 7/1992 | Berger | 57/231 |
| 5,142,743 | 9/1992 | Hahn | 24/16 R |

*Primary Examiner*—William Stryjewski
*Attorney, Agent, or Firm*—Sheridan Ross P.C.

[57] ABSTRACT

A rope-like instrument comprising hook and loop fabric to facilitate self-attachment. The instrument wraps about itself to form a closed loop, in place of forming a knot in the rope.

4 Claims, 7 Drawing Sheets

SELF-ATTACHING ROPE

This is a Continuation-In-Part application of provisional patent application Ser. No. 60/025,948, filed on Sep. 11, 1996.

FIELD OF THE INVENTION

The present invention relates to rope, cord or similar material which is capable of easily securing itself about an object without the need for knots or similar manipulation of the rope. In particular, the present invention relates to a rope-like instrument that utilizes a hook and loop fastening system to secure itself about an object.

BACKGROUND OF THE INVENTION

There are numerous situations where a relatively strong rope or cord must be securely attached to an object so that force can be exerted against the object vis-a-vis the rope. However, it may not always be possible to reach the object to which the rope must be secured. For example, it is sometimes desirable to attach a rope to a tree limb or other inaccessible object.

In order to attach a rope to such objects, it is often necessary to loop a substantial length of rope around the object until the distal end of the rope can be accessed and knotted such that the knot can be manipulated to secure the rope around the distant object. However, this is often a difficult task and, on occasion, can lead to an insecure attachment of the rope.

It would be highly desirable to provide a rope or rope-like material which would be capable of easily attaching around an object, particularly when the user is at a distance from the object which inhibits tieing the rope about the object.

SUMMARY OF THE INVENTION

The present invention relates to a rope-like instrument which is capable of self-attachment to an object to secure the rope-like instrument to the object. According to the present invention, at least a portion of such rope-like instruments include hook and loop fabric which is adapted to attach upon itself such that the rope-like instrument can be secured about an object.

According to one embodiment of the present invention, the rope-like instrument includes a helical pattern of cylindrical hook and loop fabric wherein the helix includes alternating hook fabric and loop fabric. The rope-like instrument can include a single, double or triple helix that can optionally be wrapped around a central core material. When the instrument is thrown around an object such that the rope comes back upon itself, the rope advantageously attaches to itself to secure the rope about the object. In preferred embodiment, the hook and loop portion is attached at distal ends of the rope-like instrument.

According to another embodiment of this invention, the rope-like instrument can include at least one weighted end in order to facilitate throwing of the instrument about an object. In a preferred embodiment, at least one end of the instrument can have a Y-shaped configuration to facilitate attachment of the instrument to an object.

According to yet another embodiment of the invention, the rope-like instrument can be provided with two opposed sides, wherein one side includes hook fabric and an opposed second side includes loop fabric, wherein the fabric is spiraled to provide alternating hook and loop fabric material on a given side portion.

According to yet another embodiment, the rope can include a substantially planar material having hook fabric on one side and loop fabric on an adjacent side.

DESCRIPTION OF THE INVENTION

Figure 1:
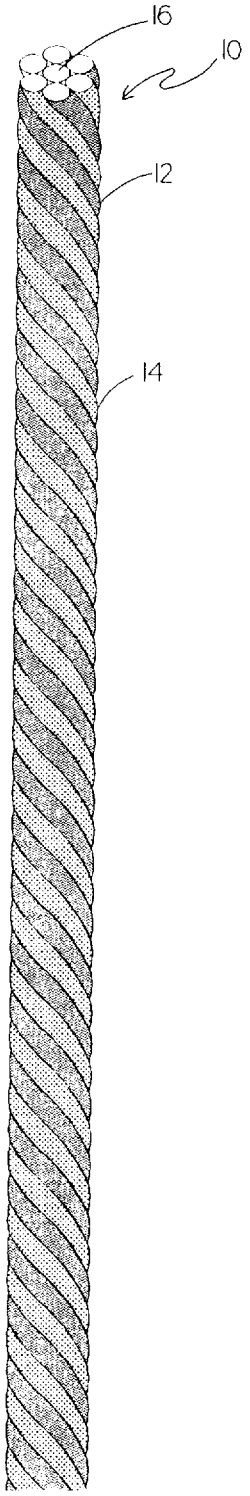
FIG. 1 illustrates a triple helix rope-like instrument according to an embodiment of the present invention.

FIG. 1 illustrates a triple helix rope-like instrument according to an embodiment of the present invention. The rope 10 includes three cylindrical cords of loop material 12 alternated with three cylindrical cords of hook material 14 which are wrapped in helical fashion around a central core 16. An example of hook and loop fabric material is that available under the trademark VELCRO, Velcro Industries, the Netherlands. The hook and loop material is on the surface of the cords 12 and 14 and the core portion of the cords can be fabricated from conventional rope materials that offer good strength, such as nylon.

Figure 2:
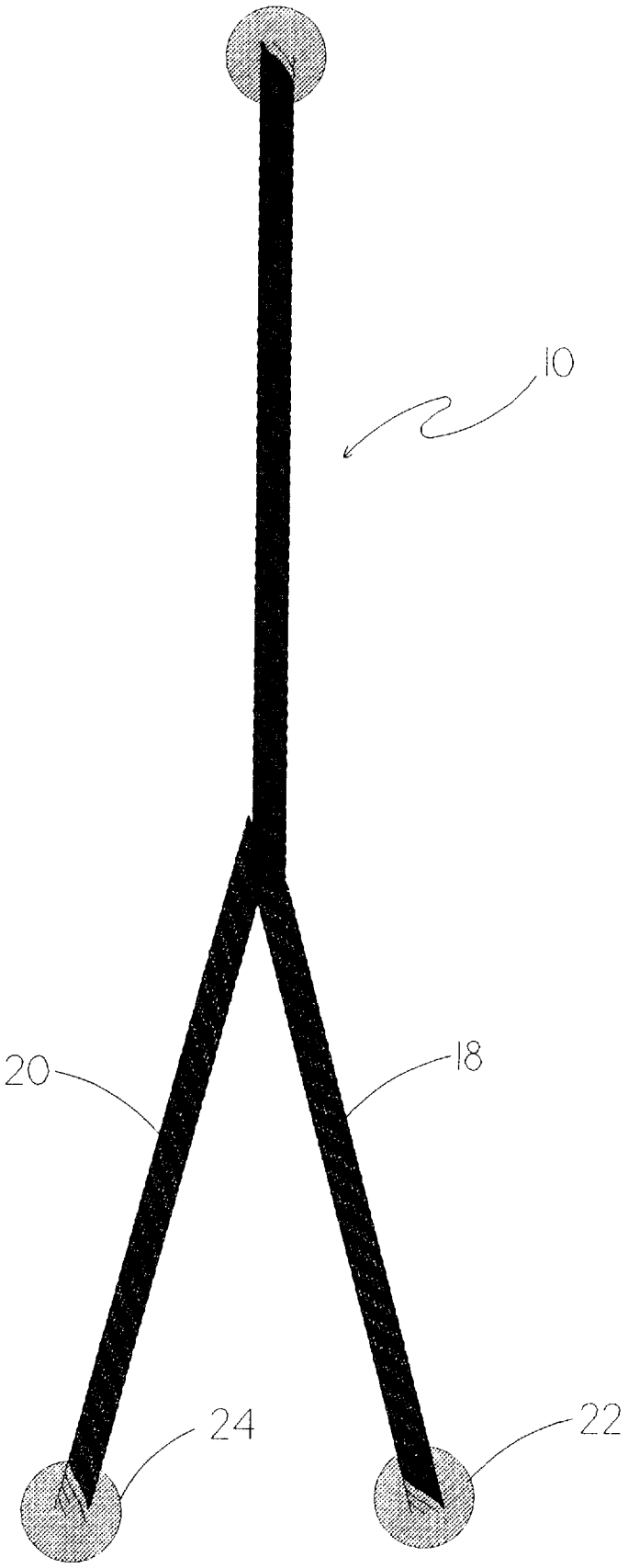
FIG. 2 illustrates a triple helix rope-like instrument having a Y configuration with weighted ends according to an embodiment of the present invention.

FIG. 2 illustrates a helical rope-like instrument similar to that of FIG. 1, which has been formed into a Y configuration. Thus, the rope 10 includes an end that is segmented into two elongate attachment portions 18 and 20. The distal ends of the attachment portions 18 and 20 have weights 22 and 24 attached thereto to facilitate throwing the rope 10 and to facilitate the self attachment of the attachment portions 18 and 20 to one another. Thus, the end of the rope that includes the Y portion can be flung about an object, such as a tree limb, and the attachment portions 18 and 20 will loop about one another and will form a secure closed loop by virtue of the contact of the hook and loop material on the attachment portions.

It will be appreciated that the closed loop will be stronger when the surface area of contacting hook and loop material is maximized. Further, although the entire rope-like instrument 10 is illustrated as including hook and loop fabric material, it will be appreciated that the rope-like instrument may be provided with conventional rope material and an end portion that includes hook and loop material, such as the end attachment portions. Also, other configurations of the end portion are possible, such as an end portion that is segmented into three or more elongate attachment portions.

Figure 3:
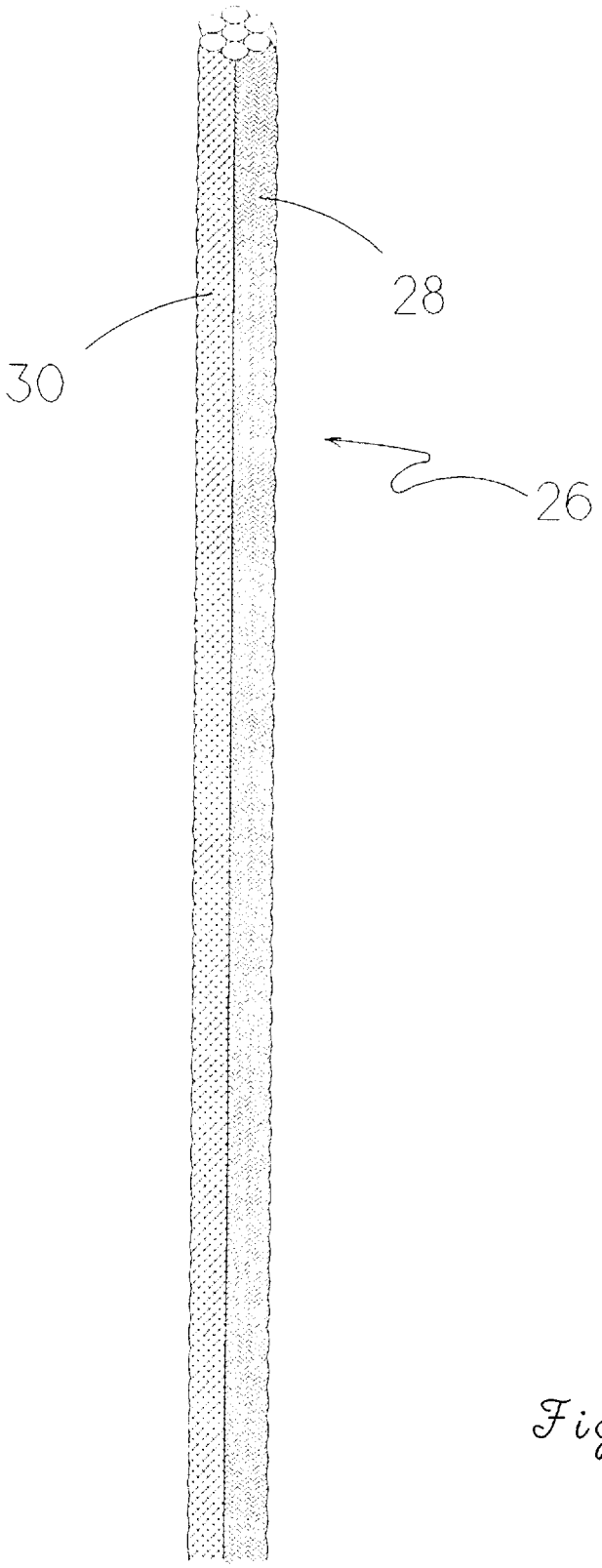
FIG. 3 illustrates a rope-like instrument with opposed surfaces of hook and loop fabric according to an embodiment of the present invention.
Figure 4:
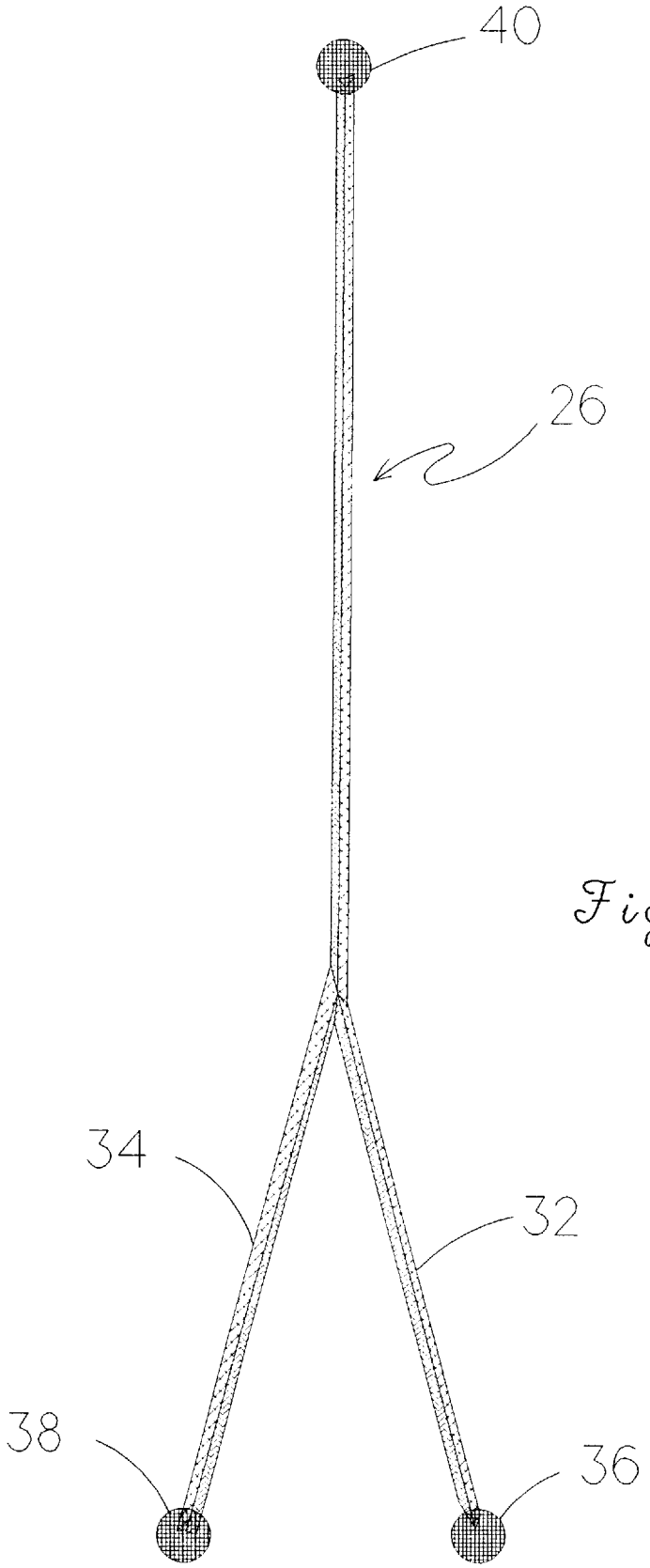
FIG. 4 illustrates a rope-like instrument with opposed hook and loop fabric and a Y configuration with weighted ends according to an embodiment of the present invention.

An alternative embodiment is illustrated in FIG. 3. The rope-like instrument 26 illustrated in FIG. 3 is similar to the instrument illustrated in FIG. 1, but the hook and loop cords 28 and 30 are in adjacent and/or opposed relation, rather than being helically wrapped. FIG. 4 illustrates the rope-like instrument of FIG. 3 which has been formed into a Y configuration. The rope 26 includes an end that is segmented into two elongate attachment portions 32 and 34. The distal ends of the attachment portions 32 and 34 include weights 36 and 38 attached thereto to facilitate throwing the rope 26 and to facilitate the self attachment of the attachment portions 32 and 34 to one another. The opposed end of the rope also includes a weight 40 to facilitate throwing or other manipulation of the rope.

Figure 5:
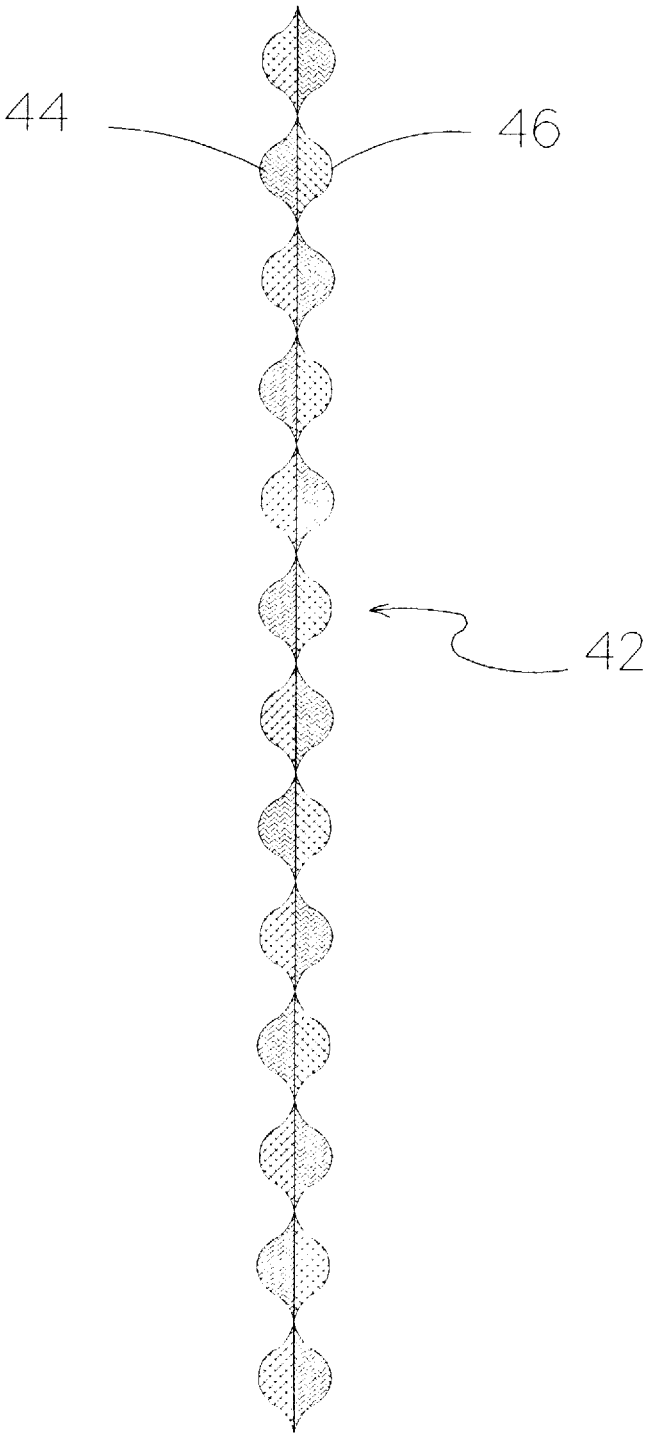
FIG. 5 illustrates a rope-like instrument including spiraled planar material with hook and loop fabric on opposed sides according to an embodiment of the present invention.
Figure 6:
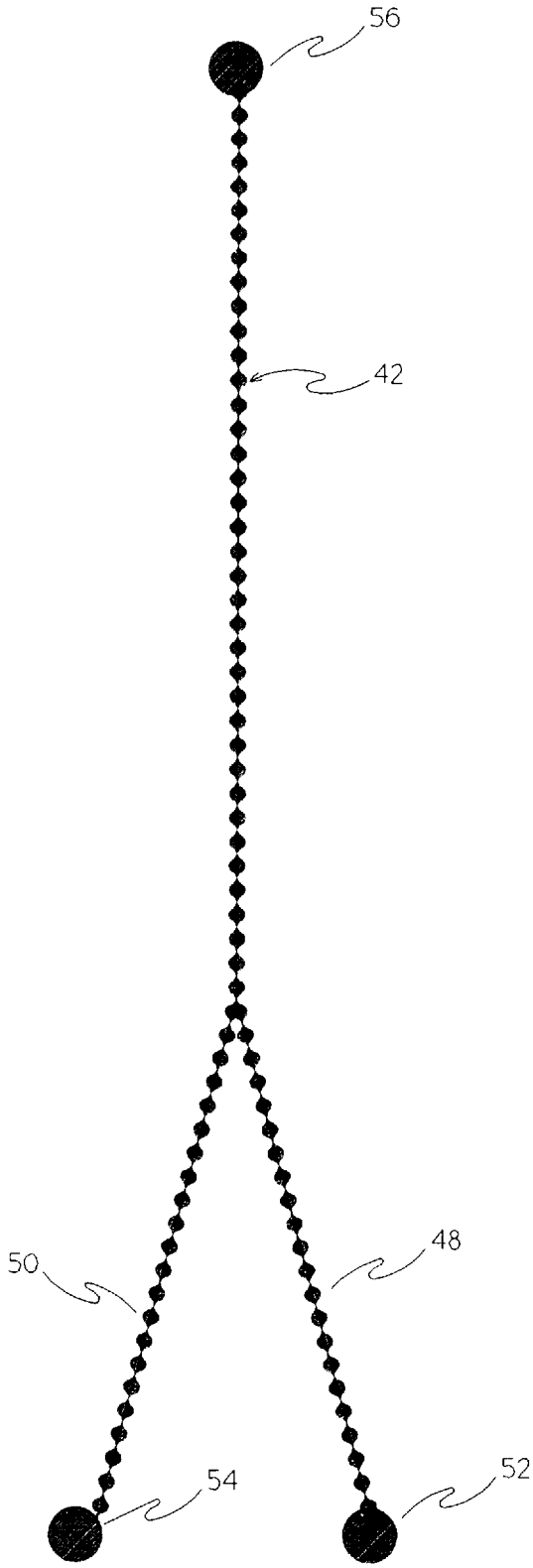
FIG. 6 illustrates a rope-like instrument including spiraled planar material with hook and loop fabric on opposed sides and including a Y configuration at one end and with weighted ends according to an embodiment of the present invention.

Another embodiment of the invention is illustrated in FIG. 5. According to this embodiment, a rope-like instrument 42 includes an elongate flat strip of material having opposed surfaces, a first surface 44 comprising hook material and an opposed second surface 46 comprising loop material. The flat strip is permanently twisted into a helical shape such that any given side portion has alternating hook and loop fabric. FIG. 6 illustrates the rope-like instrument of FIG. 5 which has been formed into a Y configuration. The rope 42 includes an end that is segmented into two elongate attachment portions 48 and 50. The distal ends of the attachment portions 48 and 50 include weights 52 and 54 attached thereto to facilitate throwing the rope 42 and to facilitate the self attachment of the attachment portions 48 and 50 to one another. The opposed end of the rope also includes a weight 56.

Figure 7:
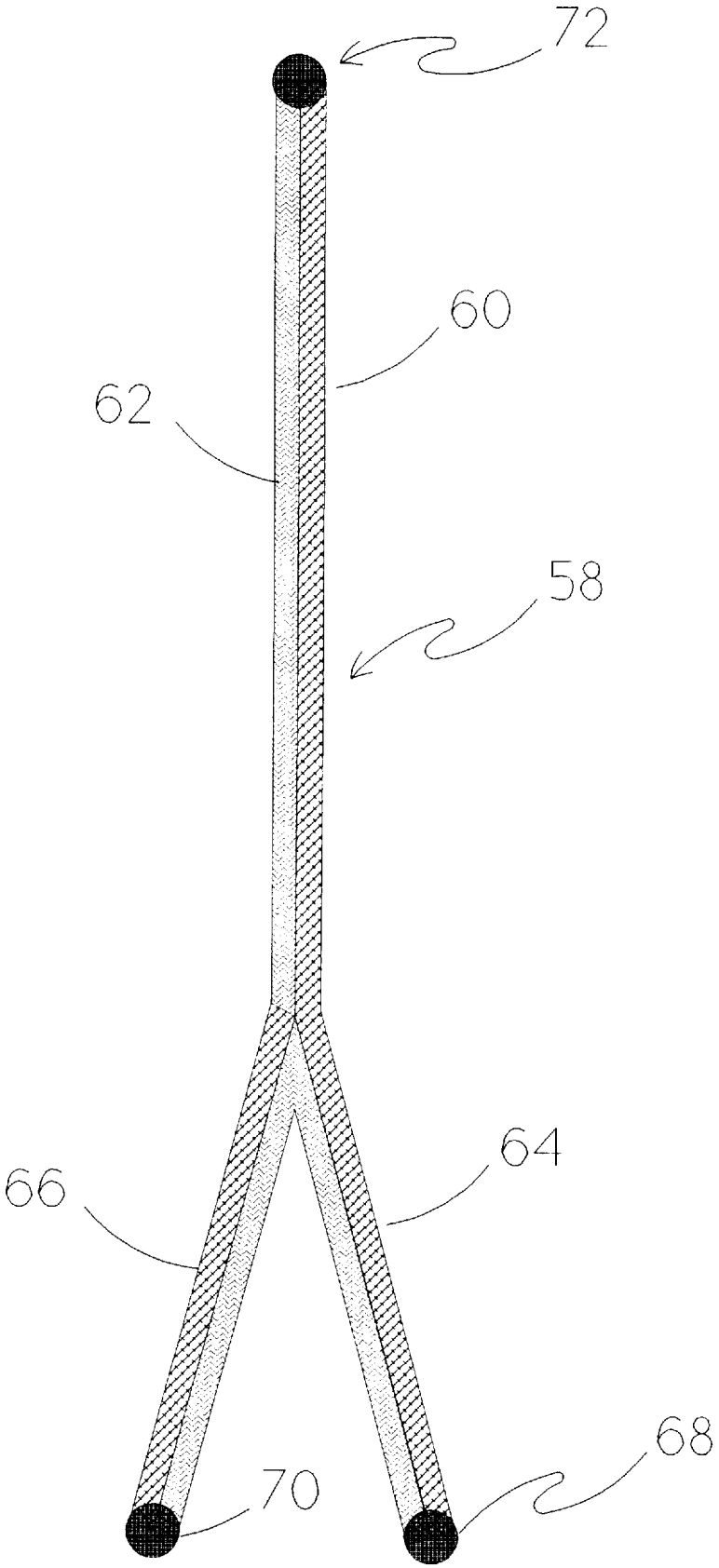
FIG. 7 illustrates a flat rope-like instrument with adjacent hook and loop fabric and including a Y configuration at one end and weighted ends according to an embodiment of the present invention.

Yet another embodiment of the invention is illustrated in FIG. 7. FIG. 7 illustrates a rope-like instrument 58 which has been formed into a Y configuration. The rope 58 is a substantially flat elongate strip of material having adjacent hook and loop portions 60 and 62. The rope 58 also includes an end that is segmented into two elongate attachment portions 64 and 66. The distal ends of the attachment portions 64 and 66 include weights 68 and 70 attached thereto to facilitate throwing the rope 58 and to facilitate the self attachment of the attachment portions 68 and 70 to one another. The opposed end of the rope also includes a weight 72.

Although various embodiments of the present invention have been described in detail, it is apparent that modifications and adaptations of those embodiments will occur to those skilled in the art. However, it is to be expressly understood that such modifications and adaptations are within the spirit and scope of the present invention.

What is claimed is:

1. A rope having self attachment means, comprising:

a) a length of at least one of a first self attaching material wrapped around a central core material;

b) a length of at least one of a second self attaching material wrapped around said central core material and positioned substantially adjacent said first self attaching material, wherein when one portion of said self attaching rope comes in contact with a second portion of said self attaching rope said first portion and said second portion become interconnected.

2. The self attaching rope of claim 1, wherein said first self attaching material comprises a hook fabric and said second self attaching material comprises a loop material.

3. The self attaching rope of claim 1, wherein at least one end of said rope has a plurality of end members for interconnecting to one another.

4. The self attaching rope of claim 1, wherein at least one end of said rope has a Y-shaped end member for interconnecting to one another.

* * * * *